US007796900B2

(12) United States Patent
Playfair

(10) Patent No.: US 7,796,900 B2
(45) Date of Patent: Sep. 14, 2010

(54) DEVELOPER CARTRIDGE REPLACEMENT SCHEME FOR ELECTROSTATOGRAPHIC PRINTING

(75) Inventor: David B. Playfair, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 909 days.

(21) Appl. No.: 11/602,911

(22) Filed: Nov. 21, 2006

(65) Prior Publication Data

US 2008/0118256 A1 May 22, 2008

(51) Int. Cl.
*G03G 15/08* (2006.01)

(52) U.S. Cl. ..... 399/27; 399/8; 399/29; 399/30

(58) Field of Classification Search ..... 399/8, 399/27, 29, 30
See application file for complete search history.

(56) References Cited

U.S. PATENT DOCUMENTS 4,614,165 A 9/1986 Folkins et al.
5,450,178 A * 9/1995 Kawashima et al.
5,585,899 A 12/1996 Palumbo et al.
6,248,496 B1 6/2001 Galloway et al.
6,272,298 B1 * 8/2001 Yamaguchi et al.
6,466,749 B1 10/2002 O'Brien
6,798,997 B1 9/2004 Hayward et al.
2004/0170442 A1 9/2004 Forbes, II et al.
2005/0214000 A1 * 9/2005 Kojima et al. ..... 399/27

FOREIGN PATENT DOCUMENTS

JP 55090981 A * 7/1980

* cited by examiner

*Primary Examiner*—David M Gray
*Assistant Examiner*—Laura K Roth
(74) *Attorney, Agent, or Firm*—Prass LLP

(57) ABSTRACT

An electrostatographic printer includes a development housing for supplying developer to an image receptor, and a replenisher in communication with the development housing. In a basic state, a regular supply of developer having a first predetermined TC is supplied. In a special state, a special supply of developer having a second predetermined TC is supplied. In response to determining the printer should be in the special state, the special supply of developer is requested to be installed in the printer, such as through Internet ordering to a vendor. The vendor can also "custom-blend" a developer formulation based on transmitted machine conditions.

15 Claims, 5 Drawing Sheets

DEVELOPER CARTRIDGE REPLACEMENT SCHEME FOR ELECTROSTATOGRAPHIC PRINTING

TECHNICAL FIELD

The present disclosure relates to a method for operating an electrostatographic or xerographic printing device. More particularly, the teachings herein are directed to maintaining material in a development housing within a predefined state.

BACKGROUND

The process of electrostatographic printing includes the step of charging an imaging member to a substantially uniform potential to sensitize the surface thereof. A latent image is generated on the charged portion of the surface of the imaging member by, in electrophotographic printing, exposure to a light image from, for example, an original document being reproduced, a scanning laser beam, an LED source, etc. or, in electron beam imaging and ion deposition printing, deposition of charges on the imaging medium. The recorded latent image is then developed by bringing a developer material into contact therewith. This forms a toner powder image on the imaging member that is subsequently transferred to a substrate, such as paper. Finally, the toner powder image is permanently affixed to the substrate in image configuration, for example by heating and/or pressing the toner powder image.

It is known that maintaining the state of the material in the developer housing within an optimum range improves developability and transfer efficiency. To accomplish this, many printing systems use a variety of processes to maintain the state of the developer materials within the optimum range by monitoring and controlling one or more characteristics of the materials including, for example, temperature, humidity, charge, toner concentration (ratio of toner to carrier) and toner charge distribution.

However, even if the developer materials are maintained in an optimal state it has been observed that when running low area coverage jobs the developability and/or transfer efficiency can fall off due to changes in the materials state in the developer housing. This fall off in developability and/or transfer efficiency produces weak, mottled and/or streaky images and can cause the process controls to use all of the printer's operating space in trying to correct the problems. With existing printing devices, when running low area coverage jobs and a reduced image quality suspected to result from a fall off in developability or transfer efficiency is observed, it is known to address the problem by either changing the materials within the developer housing(s) or by running a large number of prints (e.g., 1-2 thousand) of a high area coverage document to remove "bad" toner from the developer housings.

U.S. Pat. No. 4,614,165, assigned to the assignee hereof, describes what has come to be known as a "trickle" development system. In brief, a trickle development system provides a replaceable cartridge of developer ("developer" in this context comprising toner and carrier) that trickles its contents at a predetermined rate into a developer housing. The housing is the repository of the developer that is directly available for development of an electrostatic latent image. The developer in the housing has a desired "TC" for best performance in image quality, transfer efficiency, and other possible measures. ("TC," as used herein, is some measurable and/or controllable value derived at least in part from the relative amounts, by weight or otherwise, of toner and carrier in the developer; the TC can be a simple ratio or percentage, or can be a more sophisticated number with other values, such as charge, associated therewith.) The developer in the cartridge (the cartridge being sometimes called a "replenisher") has a TC significantly different from that of the developer in the housing, but is designed to maintain the desired TC in the housing as the cartridge gradually introduces its developer into the housing.

Over the years the basic trickle concept has been refined. U.S. Pat. No. 6,248,496 teaches a practical application of the concept. U.S. Pat. No. 6,466,749 shows a feedback-control system in which pure toner and pure carrier are available through separate controllable "taps" to maintain a desired TC within a developer housing.

Another strategy for maintaining a desired TC is to provide occasional "purges" of residual developer, such as by causing the printer to output images having high toner density. An example of such a technique is shown in U.S. Published Patent Application 2004/0170442-A1.

Also of interest to the present disclosure are: U.S. Pat. No. 5,585,899, which shows multiple replenisher cartridges associated with a single development unit; and U.S. Pat. No. 6,798,997, which shows network-based automated reordering of toner cartridges as needed by a machine.

SUMMARY

According to one embodiment, there is provided a method of operating an electrostatographic printer, the printer including a development unit, the development unit having a development housing for supplying developer to an image receptor, and a replenisher in communication with the development housing. In a basic state, supplying a regular supply of developer having a first predetermined TC is supplied. In a special state, a special supply of developer having a second predetermined TC is supplied. In response to determining the printer should be in the special state, the special supply of developer is requested to be installed in the printer.

DETAILED DESCRIPTION

Figure 1:
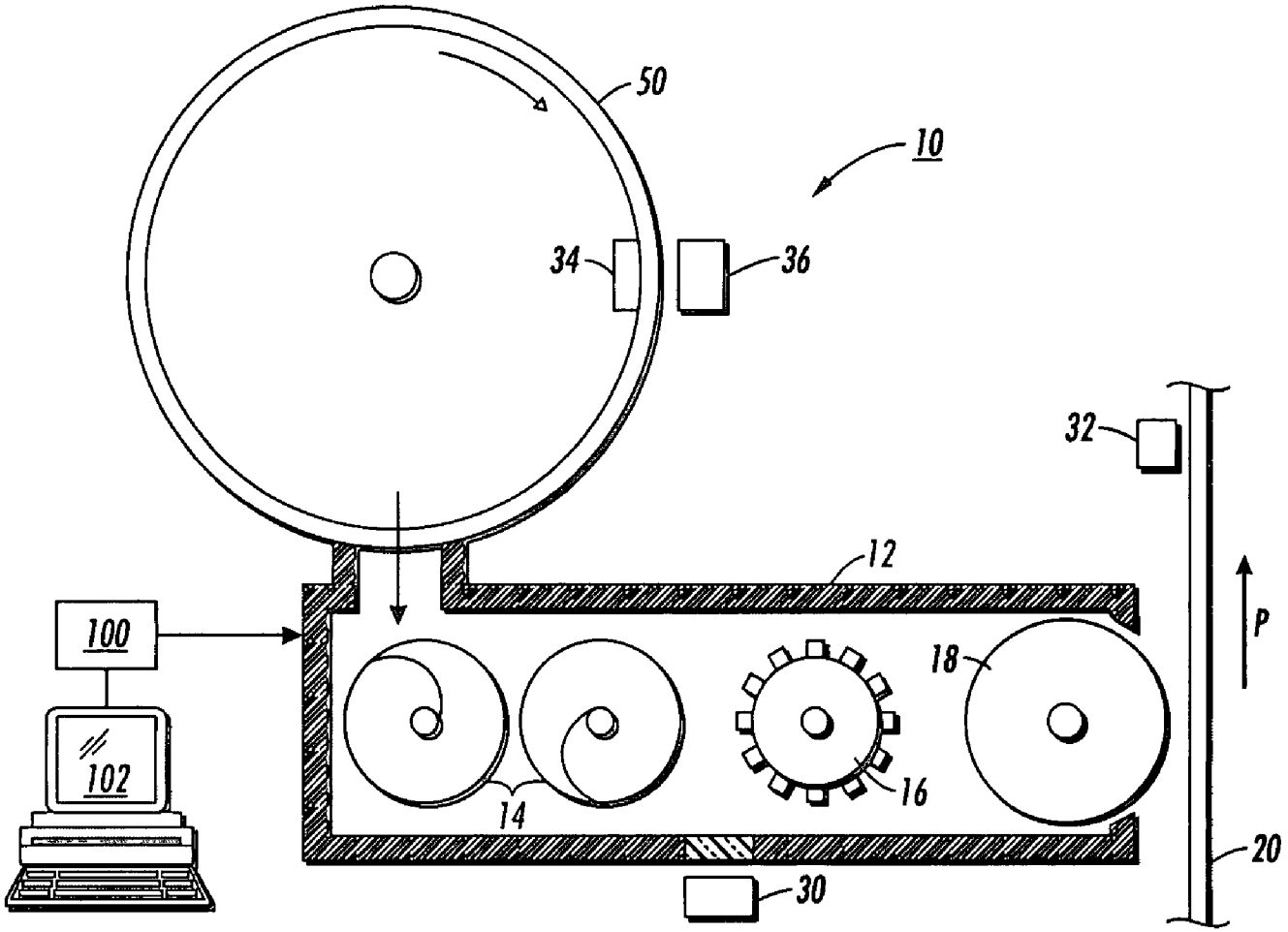
FIG. 1 (PRIOR ART)
FIG. 1 is a simplified elevational view of a development unit used in a printer, as is generally familiar in xerography.

FIG. 1 is a simplified elevational view of a development unit used in a printer, as is generally familiar in xerography. (As used herein, "printer" can apply to any machine that outputs prints, such as a printer, copier, facsimile, or multifunction machine.) The development unit 10 includes a development housing 12, which acts as a reservoir for developer immediately available for application to an electrostatic latent image. Within the development housing 12 is typically included augers 14, paddle wheel 16, and a magnetic roll 18, although many variations in design exist. The magnetic roll 18 provides a magnetic brush to apply toner particles to an electrostatic latent image on an image receptor 20, which moves in a process direction P.

A typical development unit such as 10 may further have associated therewith sensors, such as sensor 30, associated with the supply of developer in the development housing 12; or sensor 32, which monitors test patches created by the development unit 10. Sensor 32 is an optical sensor, but sensor 30 can make any kind of necessary physical measurement on the developer as needed, and can be an optical, magnetic, or electrical sensor, as generally known in the art. Sensors 30, 32 output signals (to a control system, not shown) correlative of the overall "quality" of the developer in development housing 12 at any given time, and in many instances, the quality of the developer relates to the TC of the developer in development housing 12.

A replenisher cartridge 50 empties developer into the development housing 12. As shown, replenisher cartridge 50 is cylindrical (viewed end-on in the Figure) and rotates about its axis by a motor (not shown) in the printer, emptying out some predetermined amount of developer with each rotation. The replenisher cartridge 50 is of course readily replaceable within the printer as needed.

A cartridge 50 can include what can be called a "data holder" 34, that interacts with a sensor 36 forming part of the printer. Data is communicated from the data holder 34 to sensor 36 at various times, either continually or at installation of cartridge 50 in the printer. In one embodiment, data holder 24 includes a memory chip and a hard connector or very short range RF transmitter for communication to and from the sensor 36. In various alternative embodiments, the data holder 34 could be an optical mark, such as a bar code, readable by a photosensor forming sensor 36; or, even simpler, some sort of solid structure, such as an indentation or protrusion, detectable by a mechanical sensor forming sensor 36. For present purposes data holder 34 holds, and effectively communicates via sensor 36, enough data to indicate what type of developer is held within a particular cartridge 50.

As described above, in the basic "trickle development" arrangement, the TC (as defined above) of the developer within replenisher cartridge 50 is significantly different from the TC of the developer within development housing 12. However, over time, it is intended that the TC of the developer within development housing 12 stays constant as it is replenished by toner and carrier from replenisher cartridge 50.

According to the present disclosure, there are provided two types of developer, which can be called regular developer, supplied to the development unit 10 in a regular replenisher cartridge such as 50, and special developer, in what can be called a special replenisher cartridge. The special developer has a TC or other property significantly different from that of the regular developer. In one embodiment, the regular developer has an about 3:1 ratio of toner to carrier by weight, while the special developer has an about 5:7 ratio of toner to carrier by weight. The increased carrier concentration is limited to allowing a minimal toner concentration to sustain desired area coverage.

The special replenisher cartridge is installed in a printer in response to predetermined conditions in which the special developer would improve the quality (however defined) of the developer in the development housing 12, or by extension improve the image quality (however defined) of the printer. In an embodiment, the occasional installation of the special developer in a special replenisher cartridge will have the effect of "purging" the developer in development housing 12, or in other words decreasing the age of the carrier in the development housing 12 at an accelerated rate.

Figure 2:
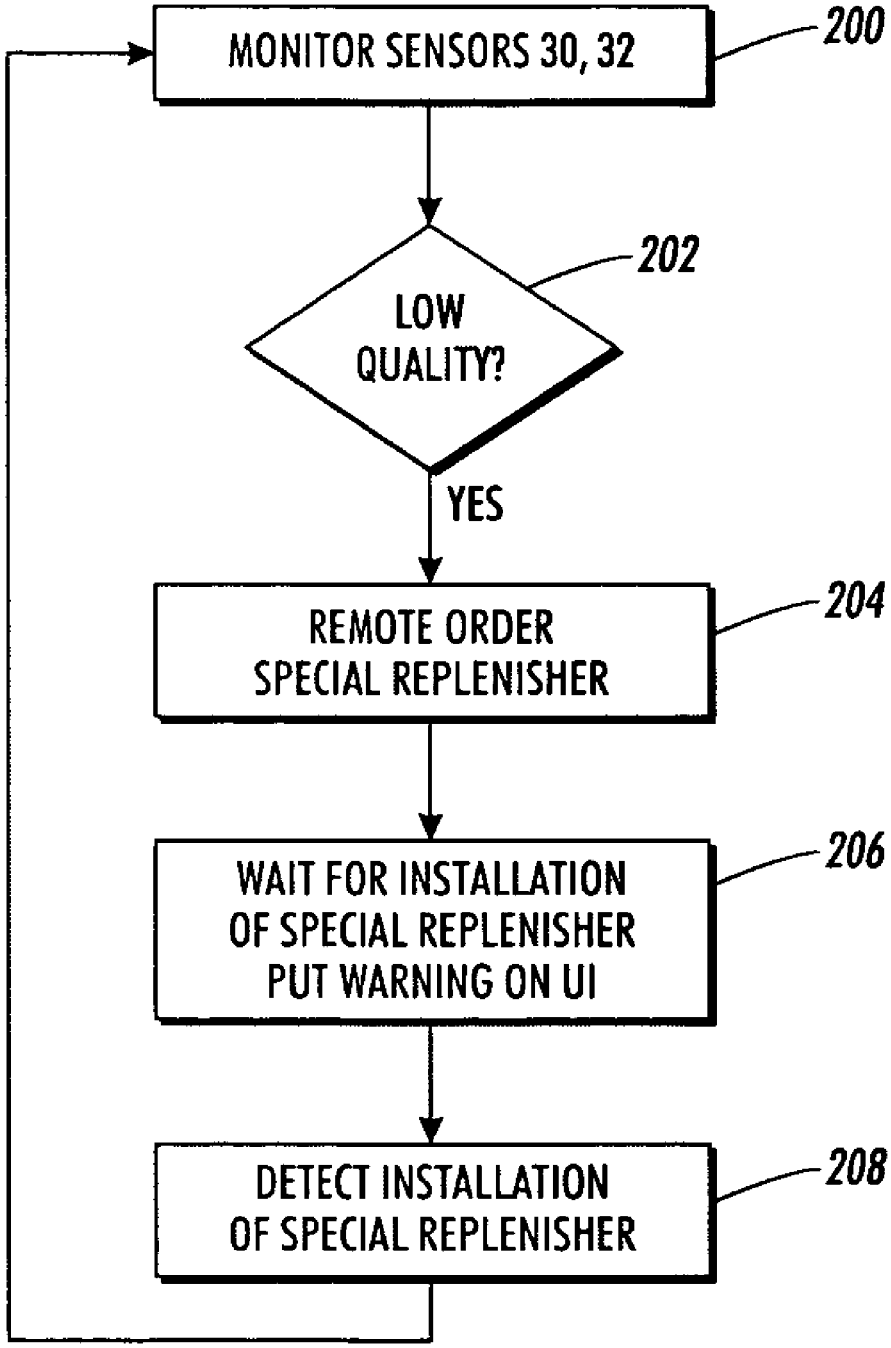
FIG. 2 is a flowchart of a control method for a printer.

FIG. 2 is a flowchart of a control method for a printer. As shown in the Figure, the signals from sensors 30 and/or 32 as described above are monitored to detect predetermined conditions of low quality of the developer in the development housing 12 or of a developed image on image receptor 20 (step 200). Initially, the printer runs in what can be called a basic state until the predetermined conditions are detected, in which case the printer enters what can be called a special state. If the low quality is deemed to be addressable by a purge of developer in development housing 12 (step 202), a control system governing the printer places an Internet or other type of order for a special replenisher cartridge (step 204). Broadly speaking, the control system requests, of a human and/or an automated system, that the special replenisher be installed in the printer. While the printer is in effect waiting for the special replenisher cartridge to be installed, a warning is displayed on the user interface (UI) of the printer, indicating that the print quality may be suboptimal (step 206), although it is possible the printer can still be allowed to run. At some time the special replenisher cartridge is detected, such as by sensor 36 in FIG. 1, as being installed in the printer (step 208).

Figure 3:
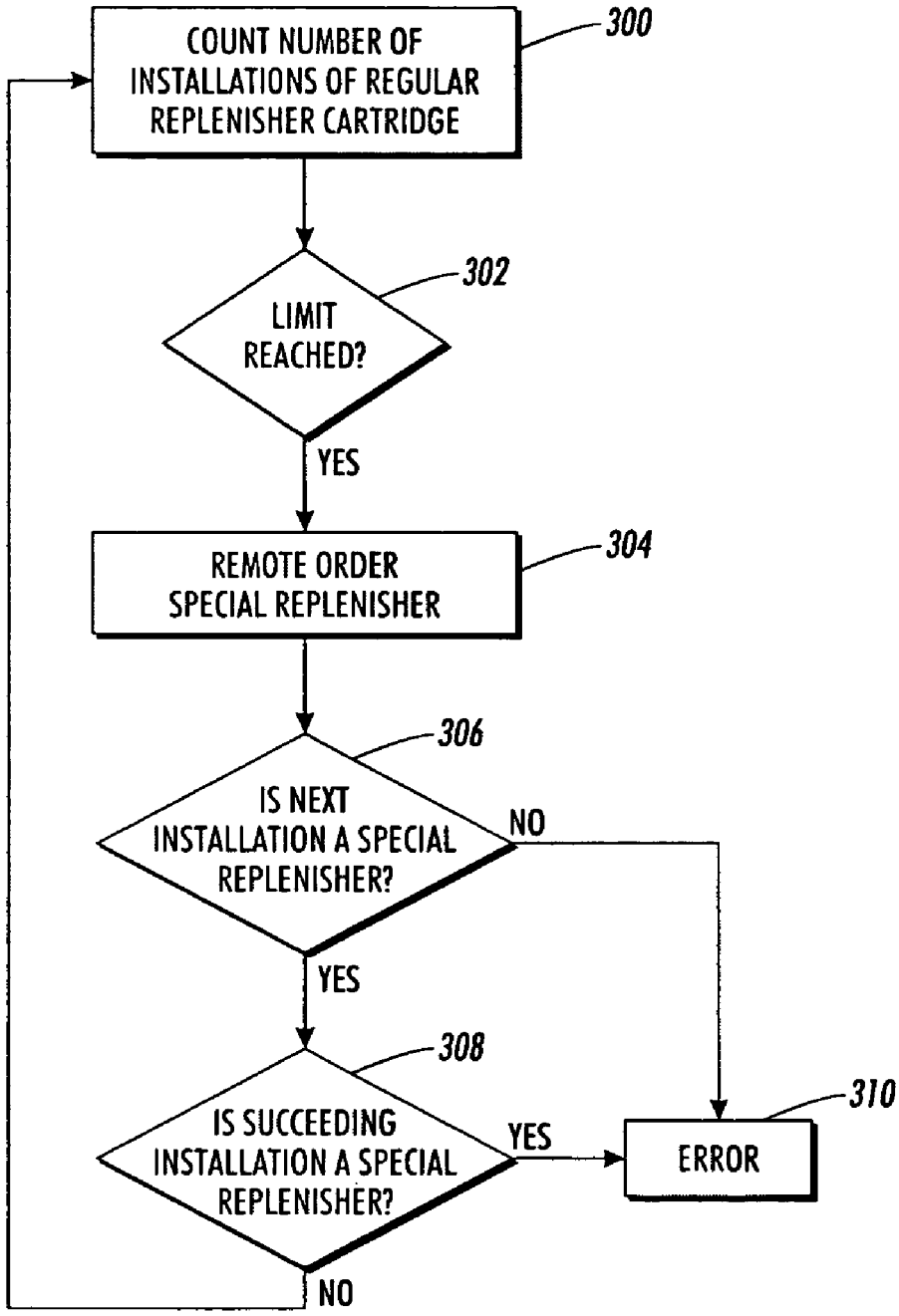
FIG. 3 is a flowchart of an alternative control method for a printer.

FIG. 3 is a flowchart of an alternative control method for a printer. In this method, the main input is simply a count of the number of times a regular replenisher cartridge has been installed in the printer. This simple count can serve as a useful determinant of when the TC of the developer in development housing 12 is outside a desirable range, a condition that can be remedied by installation of a special replenisher cartridge. A count is maintained of how many times a regular replenisher cartridge has been installed in the printer (step 300). When a predetermined number of installations has been reached (step 302), a special replenisher cartridge is ordered, over the internet or otherwise (step 304). The method can then check whether the next-installed replenisher cartridge is a special replenisher cartridge (step 306), such through a sensor 36 in FIG. 1. If the next-installed replenisher cartridge is a special replenisher cartridge, the following replenisher cartridge is a special replenisher cartridge should be a regular cartridge (step 308). If the special replenisher cartridge is not installed, or installed but not followed by a regular cartridge, an error message is displayed (step 310), either on a user interface, on some laptop display used by service personnel, or at some central computer.

The steps in the above methods may be carried out by a program installed "on-board" the control system of an individual printer, such as in a control system 100 shown in FIG. 1; alternatively, all or some of the respective method steps can be performed by an external computer, such as shown in FIG. 1 as 102, governing one printer or a population of printers. (In various possible practical embodiments, different aspects of the FIG. 2 or FIG. 3 methods may be combined.) A practical advantage of the methods is that in many cases they can be implemented on printers already installed at customer sites, with the information relevant to the decision whether to install a special replenisher cartridge being sent to a central computer, or collected by service personnel. Particularly with the FIG. 3 method, no significant modification of any sensors or internal control systems within a printer is necessary to enable a desirable purge or fine-tuning of the developer in a development housing 12. The internet-based ordering of replenisher cartridges of a particular type can be carried out along the general lines shown in U.S. Pat. No. 6,798,997, referenced above.

In a more sophisticated embodiment, there could be provided, for ordering and installation in a printer at various times, a plurality of possible special replenisher cartridge types, each type having for instance a specific TC, or having a particular set or proportion of certain additives. If there were, for instance, three types of special replenisher cartridges, the three types could be ordered for installation in a predetermined sequence, such as to carry out a relatively gradual desired change in the character of the developer in development housing 12. (In such an arrangement, a printer may have more "special" than "regular" replenisher cartridges installed therein over time.) Alternatively, one of the three available types of special replenisher cartridge could be ordered as needed depending on a specific type or extent of image- or developer quality problem as detected by sensors 30 or 32.

Figure 4:
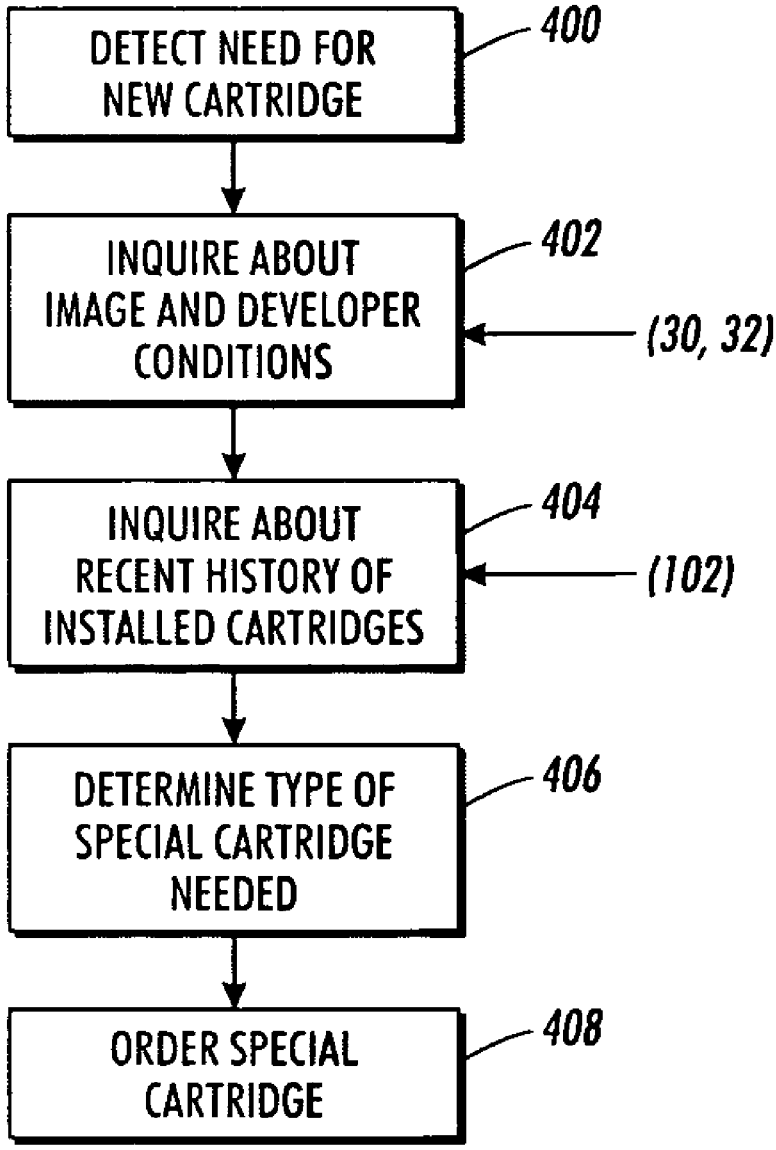
FIG. 4 is a flowchart of an alternative control method for a printer.

In another embodiment, a special replenisher cartridge can be, in effect, specially designed to address an ad-hoc image-quality problem as detected by sensors 30 or 32. FIG. 4 is a flowchart of an alternative control method for a printer. In this embodiment, a control system governing a printer sends information about current or recent-historical conditions associated with the printer to an external computer, incidental to ordering a special replenisher cartridge. If a condition mandating ordering a new cartridge is detected (step 400), the control system (such as 100 in FIG. 1) inquires about the current image and developer conditions, based on inputs from sensors 30 or 32 (step 402), and also inquires about the recent history of what types of regular or special replenisher cartridges have been installed in the printer in the recent past (step 404). This recent-history inquiry can exploit data held either within the control system 100 for the printer itself, or at a central governing computer 102. In brief, the recent-history data is useful for determining or estimating an age (in a statistical sense) of the toner within development housing 12; as is generally known in xerography, the age of the toner particles since installation correlates with various electrostatic properties of the developer, which in turn correlate with incidence of many image-quality problems that can be detected by sensor 32. The data derived from the inquiries can be entered into an algorithm (step 406) for determining what type of regular or special replenisher cartridge should be ordered (step 408). In one possible embodiment, a developer formulation could be "custom-blended," in terms of (for example) TC, additives, and total mass, by a vendor in response to receiving a particular set of data relating to machine or image conditions, along with an order for a new replenisher cartridge.

Once a special replenisher cartridge is installed in a printer, and identified by the printer such as through data holder 34 and sensor 36, the control system such as 100 could adjust the delivery rate of the developer to development housing 12 based on the particular replenisher cartridge contents formulation.

Figure 5:
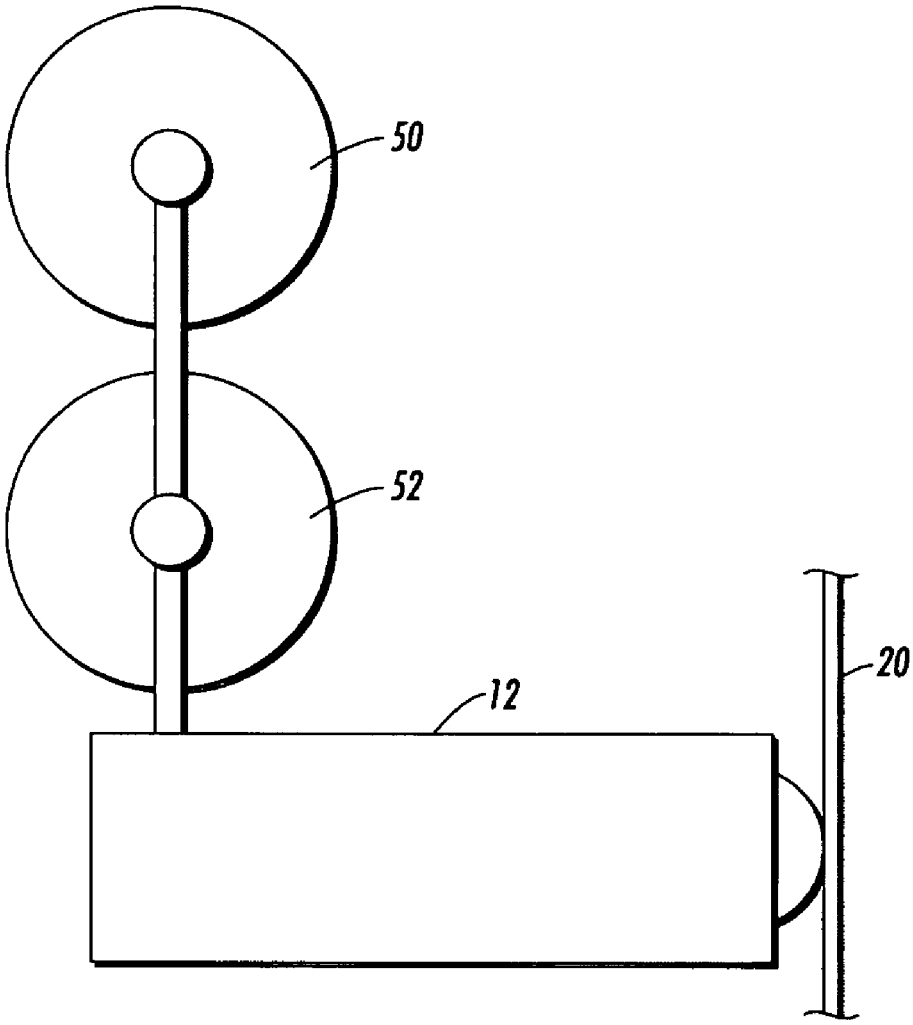
FIG. 5 is a simplified diagram of a printer with multiple replenisher cartridges available to a single development housing.

FIG. 5 is a simplified diagram of a printer with multiple replenisher cartridges 50 available to a single development housing 12. A similar arrangement is shown in U.S. Pat. No. 5,585,899, referenced above. In such an arrangement, the upper or lower replenisher cartridge can be rotated to deposit a predetermined amount of developer in the development housing 12. The basic methods described above can be adapted for use with such a multi-cartridge system, where a user can be instructed to install a regular replenisher cartridge, such as indicated as 50, in one location and a special replenisher cartridge such as indicated as 52, in the other. A control system, whether implemented in whole or in part within the printer or on an external computer, can control the depositing of regular or special developer as needed into development housing 12.

A special replenisher cartridge need not have the same, nor even a comparable, total amount of toner or developer as a regular replenisher cartridge. All that is required for an embodiment is that the special replenisher cartridge have enough developer to cause the desired purging or fine-tuning of TC in the development housing 12 before it substantially empties. The total developer mass in the special replenisher cartridge can be, in some instances, less than 50% of that of a regular replenisher cartridge. Also, a special replenisher cartridge may differ from a regular replenisher cartridge by having different additives or proportions of additives (broadly speaking, an "additive set"), such as for aiding physical flow or charge retention.

Although the above-described embodiments are directed to a monochrome printer, the above teachings can readily be applied to any single development unit within a color electrostatographic printer of any type.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A method of operating an electrostatographic printer, the printer including a development unit, the development unit having a development housing for supplying developer to an image receptor, and a replenisher in communication with the development housing, the method comprising:

in a basic state, supplying a regular supply of developer to the development housing, the regular supply of developer having an about 3:1 ratio of toner to carrier by weight and having a first predetermined TC (where the TC is a measurable and/or controllable value derived at least in part from the relative amounts of toner and carrier in the developer);

in a special state, supplying a special supply of developer to the development housing, the special supply of developer having an about 5:7 ratio of toner to carrier by weight and having a second predetermined TC;

determining whether the printer should be in the special state based on the quality of developer in the development housing; and in response to determining the printer should be in the special state, requesting the special supply of developer be installed in the printer to improve the quality of the developer in the development housing.

2. The method of claim 1, wherein the regular supply of developer has an additive set different from an additive set of the special supply of developer.

3. The method of claim 1, the regular supply of developer being contained in a replenisher cartridge of a regular type, and the special supply of developer being contained in a replenisher cartridge of a special type.

4. The method of claim 1, the determining including maintaining a count of cartridges of the regular type used by the printer.

5. The method of claim 4, the determining further including causing a cartridge of the special type to be installed, in response to the count of cartridges reaching a predetermined number.

6. The method of claim 1, the determining including performing an image-quality measurement of an image placed on the image receptor within the printer.

7. The method of claim 6, the image-quality measurement including measuring an optical density of the image placed on the image receptor.

8. The method of claim 1, the determining including performing a physical measurement relating to developer in the developer housing.

9. The method of claim 8, the physical measurement including at least one of an optical measurement, electrical measurement, magnetic measurement, or mass measurement.

10. The method of claim 1, the determining including maintaining a record of types of developer associated with the development unit in the past.

11. The method of claim 10, the determining including using historical data including average replenisher usage over a determined amount of time sufficient to conclude a similar future usage of replenisher.

12. The method of claim 1, further comprising in response to the requesting, ordering a special developer for the printer.

13. The method of claim 12, wherein the special developer has a special developer formulation based at least in part on data relating to a condition associated with the printer.

14. A method of operating an electrostatographic printer, the printer including a development unit having a development housing for supplying developer to an image receptor, and a replenisher in communication with the development housing, the method comprising:

in a basic state, supplying a regular supply of developer to the development housing, the regular supply of developer comprising toner and carrier and having a first predetermined TC (where the TC is a measurable and/or controllable value derived at least in part from the relative amounts of toner and carrier in the developer), the regular supply of developer being contained in a replenisher cartridge of a regular type;

in a special state, supplying a special supply of developer to the development housing, the special supply of developer comprising toner and carrier and having a second predetermined TC, the special supply of developer being contained in a replenisher cartridge of a special type having a total mass of developer substantially less than a total mass of developer contained in the replenisher cartridge of a regular type:

determining whether the printer should be in the special state based on the quality of developer in the development housing; and in response to determining the printer should be in the special state, requesting the special supply of developer be installed in the printer to improve the quality of the developer in the development housing.

15. The method of claim 14, the replenisher cartridge of a special type having a total mass of developer more than 50% less than a total mass of developer in the replenisher cartridge of a regular type.

* * * * *